US007049535B2

(12) United States Patent
Matsuyama et al.

(10) Patent No.: US 7,049,535 B2
(45) Date of Patent: May 23, 2006

(54) ILLUMINATED SWITCH

(75) Inventors: Eiji Matsuyama, Kawasaki (JP); Hidehiro Yamada, Kawasaki (JP)

(73) Assignee: Nihon Kaiheiki Industrial Company, Ltd., Kawasaki (JP)

( * ) Notice: Subject to any disclaimer, the term of this patent is extended or adjusted under 35 U.S.C. 154(b) by 0 days.

(21) Appl. No.: 10/937,801

(22) Filed: Sep. 10, 2004

(65) Prior Publication Data

US 2005/0150751 A1 Jul. 14, 2005

(30) Foreign Application Priority Data

Jan. 9, 2004 (JP) ..... 2004-003983

(51) Int. Cl.
*H01H 9/00* (2006.01)

(52) U.S. Cl. ..... 200/310

(58) Field of Classification Search ..... 200/310, 200/313–317, 308, 553, 339, 245, 250, 276, 200/276.1

See application file for complete search history.

(56) References Cited

U.S. PATENT DOCUMENTS

| | | | | |
|---|---|---|---|---|
| 4,191,871 | A * | 3/1980 | Coyle | 200/530 |
| 4,772,769 | A * | 9/1988 | Shumate | 200/314 |
| 4,851,619 | A * | 7/1989 | Fujita et al. | 200/6 R |
| 5,743,382 | A * | 4/1998 | Luo | 200/315 |
| 6,576,855 | B1 * | 6/2003 | Levendis et al. | 200/339 |
| 6,621,025 | B1 * | 9/2003 | Yei et al. | 200/315 |
| 6,686,550 | B1 * | 2/2004 | Seki et al. | 200/553 |

* cited by examiner

*Primary Examiner*—Elvin G. Enad
*Assistant Examiner*—M. Fishman
(74) *Attorney, Agent, or Firm*—Bacon & Thomas, PLLC

(57) ABSTRACT

An illuminated switch includes a lens that is provided integrally with a converter on a surface opposing a light-emitting element disposed on a base constituting a switch body. The lens diffuses light emitted from the light-emitting element through the inner space of a coil spring urging a switch operating unit in the vertical direction. Moreover, a tilted surface is formed at an angle inclining towards the bottom surface of a hole below from the upper surface of the switch operating unit in the axial direction.

2 Claims, 15 Drawing Sheets

ILLUMINATED SWITCH

BACKGROUND OF THE INVENTION

1. Field of the Invention

The present invention relates to an extremely small illuminated switch that is constituted by adding illuminating means to existing components of a non-illuminated switch.

2. Description of the Related Art

[A] FIG. 1 is a cross-sectional side view of a known toggle switch for a printed circuit board.

On the left and right of the toggle switch, a clip-type switching mechanism is provided. A sliding rod 6 urged by a coil spring 5 disposed inside a central lever 2 provides a clicking sensation and functions as a switching indicator of the lever 2.

The size of the above-mentioned switch is small: wherein the terminal pitch is 2.54 mm and the size of the switch body is 7×4.5 mm. It is impossible to make an illuminated switch with this size by applying a known technology.

[B] FIGS. 2 and 3 are a cross-sectional front view and a cross-sectional side view, respectively, of a known illuminated switch. A switch body is constituted of a housing 13 and a base 17. At substantially the center of the head of the housing 13, a lever 12 functioning as a switch operating unit 12*a* is inserted through a through-hole 13*a*. A contact mechanism disposed on the base 17 includes a pair of fixed contacts 17*a* and a movable contact piece 18, which moves together with the switch operating unit 12*a* and is fixed to the lever 12. A light-emitting element 15 is also disposed on the base 17. The light emitted from the light-emitting element 15 is guided through and then diffused from the tip of the switch operating unit 12*a* composed of a transparent material.

An electronic apparatus, however, may include a plurality of reduced-size illuminated switches. In such a case, the designs of the external panels and the heights and positions of the electric components disposed on printed circuit boards differ. Therefore, in order to transmit the status of the components to an operator from the left, right, front, back, and upper directions of the illuminated switch, it is important to provide an extremely small illuminated switch that is easily visible.

An illuminated switch according to the above-mentioned related art [A] is too small to contain a space for disposing a light-emitting element and the wiring required for the light-emitting element. For this reason, a relatively high cost has been necessary for developing new components.

As illustrated in the cross-sectional side view of a known illuminated switch shown in FIG. 3, the illuminated switch according to related art [B] has the light-emitting element 15 disposed inside the switch body. The light emitted from the light-emitting element 15 is guided through the cylindrical switch operating unit 12*a* composed of a transparent material. Thus, the light is converged at the tip of the switch operating unit 12*a*, which is the end section of the illuminated switch, to brightly illuminate the tip. However, the viewable angle of the emitted light is narrow for such an illuminated switch. In particular, an illuminated switch having a switching mechanism in which the switch operating unit 12*a* is moved vertically is less visible compared to an illuminated switch having a switching mechanism in which the switch operating unit 12*a* is swung horizontally to improve its visibility.

The light-emitting element 15 illustrated in the cross-sectional view of a known illuminated switch shown in FIG. 2 is connected to the fixed contacts 17*a* by various methods, such as soldering, which applies thermal stress, and spot welding and swaging, which apply mechanical stress. Moreover, electronic apparatuses and electronic components may be connected by using a conductive adhesive having great heat resistance and fatigue resistance. Recently, such an adhesive has been used to prevent damage of the components when installing and to achieve a Freon-free, lead-free, and VOC-free environment. However, the optimal amount of conductive adhesive to be applied must be finely controlled by known production equipment and extremely fine adjustment is required for preserving the adhesive.

SUMMARY OF THE INVENTION

Accordingly, a first object of the present invention is to provide an illuminated switch that can use existing equipment of a known non-illuminated switch while taking into consideration the above problem concerning the above-mentioned related art [A].

A second object of the present invention is to provide an illuminated switch that solves the above problems, has improved visibility from the horizontal direction while maintaining high visibility from the upper direction, and has a reduced size, while taking into consideration the above problems concerning the above-mentioned related art [B].

To achieve the above-mentioned objects, the present invention includes the illuminated switches described below:

[A] An illuminated switch comprises a switch body, a plurality of fixed contacts of at least two poles, the fixed contacts being disposed on the bottom surface of the switch body so that the poles oppose each other, a switch operating unit disposed on the switch body, a switch driver connected to the switch operating unit and disposed on the switch body, and a movable contact switching in conjunction with the switch driver. Furthermore, at least one of the switch operating unit and the switch driver is composed of a transparent material, and illuminating means for illuminating the switch operating unit by guiding light emitted from a light-emitting element connected between the fixed contacts of at least one pole through at least one of the switch operating unit and the switch driver composed of the transparent material is provided.

Moreover, at least one pole of the switching unit of the illuminated switch includes a clip-type movable contact and cylindrical fixed contacts vertically disposed on the switch body. An LED is disposed between and connected to the fixed contacts of the other pole of the switching unit. Furthermore, the switching unit has multiple poles wherein each of the poles has three fixed contacts. Two light-emitting elements, each emitting a different color, are disposed on the left and right of the fixed contact in the middle of one of the poles so that the fixed contact in the middle functions as a common contact for both of the light-emitting elements. Depending on the direction in which the switch operating unit is tilted, two different colors can be emitted.

A light-emitting element is disposed between the fixed contact in the middle and one of the fixed contacts on the left and the right of the middle fixed contact. A current limitation element is connected to the fixed contact in the middle and the other contact on the left or the right.

An illuminated switch comprises a switch body, a plurality of fixed contacts of at least two poles, which is disposed on the bottom surface of the switch body so that the poles oppose each other, a switch operating unit disposed on the switch body, a switch driver connected to the switch operating unit and disposed on the switch body, and a movable contact switching in conjunction with the switch driver. A portion of the switch body is composed of a transparent material, and a light-emitting element is interposed between the fixed contacts of at least one pole to illuminate the portion of the switch body composed of the transparent material.

[B] An illuminated switch comprises a switch operating unit composed of a transparent material, a switch body, which includes a housing disposed on the switch operating unit so that the switch operating unit moves freely in the vertical direction and a base having a plurality of protruding terminals, a switching mechanism, which includes a converter composed of a transparent material and cooperates with the switch operating unit, a light-emitting element disposed on the base, and a movable contact piece that moves in accordance with the operation of the converter and functions as a change-over switch for a plurality of fixed contacts constituting at least one circuit on the bottom surface of the base. A lens is provided integrally with the converter on a surface opposing the light-emitting element. The lens diffuses light emitted from the light-emitting element through the inner space of the coil spring urging the switch operating unit vertically. Furthermore, a tilted surface is formed at an angle inclining towards the bottom surface of a hole formed below the upper surface of the switch operating unit in the axial direction.

On the base where the light-emitting element is connected, a flat surface and a protrusion are formed on the surface where at least a pair of fixed contacts is vertically disposed and at least one groove is formed.

As described in detail below, an illuminated switch according to the present invention has the following advantages:

[A]

(1) Various types of illuminated switches can be provided extremely easily since at least one of a switch operating unit and a switch driver is composed of a transparent material, fixed contacts of at least one pole are connected to a light-emitting element, and illuminating means for illuminating the switch operating unit by guiding light through the transparent material of at least one of the switch operating unit and the switch driver is added.

(2) Capital investment for developing new components can be significantly reduced since existing components of a known non-illuminated switch can be used for the illuminated switch according to the present invention. This is possible since at least one of a switch operating unit and a switch driver is composed of a transparent material, fixed contacts of at least one pole are connected to a light-emitting element, and illuminating means for illuminating the switch operating unit by guiding light through the transparent material of at least one of the switch operating unit and the switch driver is added.

(3) Inventory management becomes easy since the structure according to the present invention allows both an illuminated switch and a non-illuminated switch to be selectively constituted and, thus, components can be used commonly for both the illuminated switch and the non-illuminated switch. The illuminated switch according to the present invention comprises at least one of a switch operating unit and a switch driver composed of a transparent material, and fixed contacts of at least one pole are connected to a light-emitting element so that the light emitted from the light-emitting element is guided through the transparent material of at least one of the switch operating unit and the switch driver.

(4) An extremely small illuminated switch can be constituted extremely easily since at least one pole of the illuminated switch is composed of a clip-type movable contact and columnar fixed contacts vertically disposed inside a switch body, and the other pole, having an LED, is connected to the fixed contacts.

(5) An illuminated switch according to the present invention can be put to a wide range of uses and a switch suitable for a particular purpose can be easily selected. This is possible since the illuminated switch includes a switching unit having multiple poles, in which each of the poles is composed of three fixed contacts, and light-emitting elements, which each emit a different color and which are disposed on the left and right of the fixed contact in the middle of the three fixed contacts so that the fixed contact in the middle functions as a common contact for each light-emitting element. In this way, two different colors of light are emitted depending on the direction in which the switch operating unit is tilted. Although the illuminated switch emits two different colors, the shape of the switch is the same as a non-illuminated switch or a single-color illuminated switch. Accordingly, an illuminated switch capable of emitting two different colors, such as red and green, selected to suit a particular purpose, can be provided easily.

(6) Any method for controlling the light-emitting element with one type of switch can be selected since a light-emitting element is interposed between a fixed contact in the middle of three fixed contacts of one pole and a fixed contact disposed on either the left or the right of the middle fixed contact. A current limitation element is interposed between the middle fixed contact and the other fixed contact disposed on either the left or the right of the fixed contact in the middle.

(7) According to the present invention, an illuminated switch that illuminates light in a manner different from known illuminated switches is provided since a part of the switch body is composed of a transparent material and the fixed contacts of at least one pole are connected to a light-emitting element.

[B]

(1) An illuminating switch according to the present invention is capable of clearly illuminating a switch operating unit since a light path is formed by using a lens of the switch operating unit and the inner space of a coil spring. In this case, the lens is provided integrally with the converter on a surface opposing the light-emitting element. The lens diffuses light emitted from the light-emitting element through the inner space of the coil spring urging the switch operating unit in the vertical direction. Furthermore, a tilted surface is formed at an angle inclining towards the bottom surface of a hole formed below the upper surface of the switch operating unit.

(2) An extremely small illuminated switch that is more easily visible from the horizontal direction is provided by widening the viewable angle of the light emitted from the switch operating unit. The viewable angle is widened by guiding the light emitted from a light-emitting element disposed inside the lower portion of a switch body through the switch operating unit and reflecting the light at a tilted surface inside the switch operating unit. In this case, the lens is provided integrally with the converter on a surface opposing the light-emitting element. The lens diffuses light emitted from the light-emitting element through the inner space of the coil spring urging the switch operating unit in the vertical direction. Furthermore, the tilted surface is formed at an angle inclining towards the bottom surface of a hole formed below the upper surface of the switch operating unit.

(3) By using an illuminated switch according to the present invention, the operation status of an operating apparatus can be accurately and quickly transmitted to an operator, and, thus, safety in the work place can be assured. In this case, the lens is provided integrally with the converter on a surface opposing the light-emitting element. The lens diffuses light emitted from the light-emitting element through the inner space of the coil spring urging the switch operating unit in the vertical direction. Furthermore, a tilted surface is formed at an angle inclining towards the bottom surface of a hole formed below the upper surface of the switch operating unit.

(4) The illuminated switch according to the present invention can be easily connected and has an excellent productivity rate, which contributes to the reduction of the production cost of an apparatus. In this case, a flat surface and a protrusion are formed on a surface on a base connecting a light-emitting element. On the base, at least a pair of fixed contacts is vertically disposed and at least one groove is formed. Accordingly, the light-emitting element can be connected in three different directions, or, in other words, the light-emitting element can be connected with the left or right fixed contact or from the side surface where the protrusion is provided.

(5) Short-circuiting between fixed contacts of an illuminated switch according to the present invention caused by a conductive adhesive used as a fine connecting material for connecting a light-emitting element to the fixed contacts is prevented and, thus, production efficiency is improved. In this case, a flat surface and a protrusion are formed on a surface on a base connecting a light-emitting element. On the base, at least a pair of fixed contacts is vertically disposed and at least one groove is formed.

DESCRIPTION OF THE PREFERRED EMBODIMENTS

Figure 1:
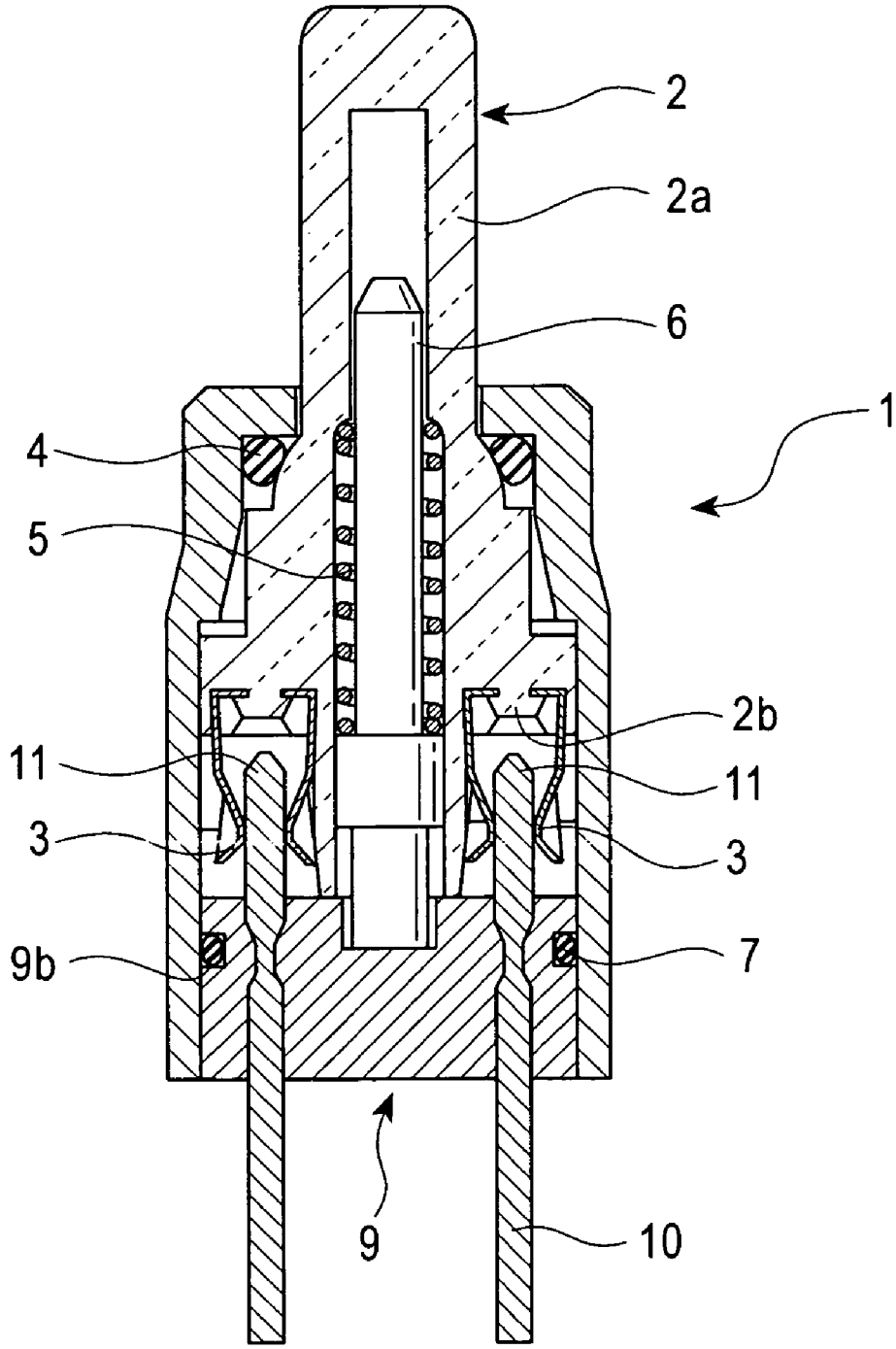
FIG. 1 PRIOR ART
FIG. 1 is a cross-sectional side view of a known toggle switch for a printed circuit board.
Figure 2:
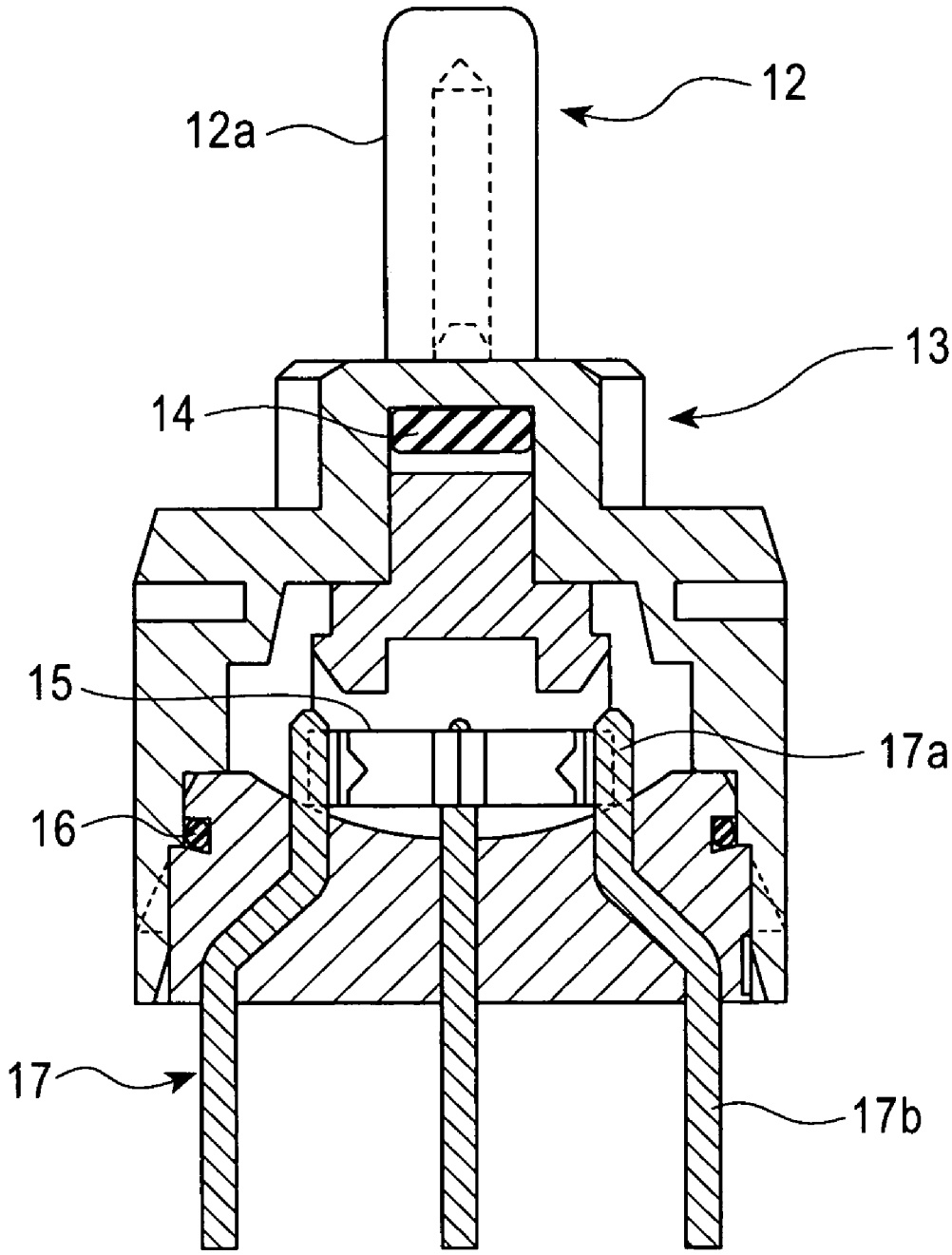
FIG. 2 PRIOR ART
FIG. 2 is a cross-sectional front view of a known illuminated switch.
Figure 3:
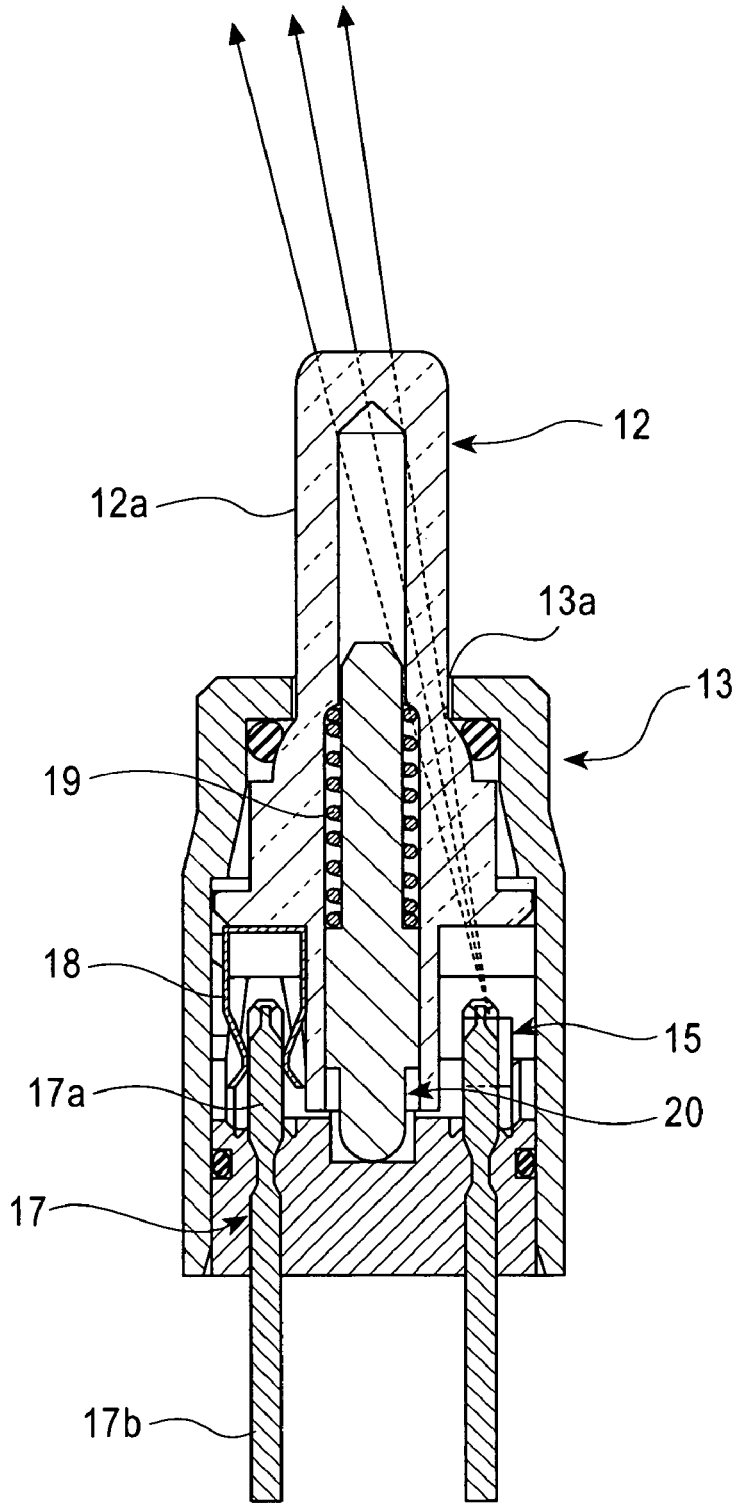
FIG. 3 PRIOR ART
FIG. 3 is a cross-sectional side view of a known illuminated switch.

[A] An illuminated switch comprises a switch body, a plurality of fixed contacts of at least two poles, the fixed contacts being disposed on the bottom surface of the switch body so that the poles oppose each other, a switch operating unit disposed on the switch body, a switch driver connected to the switch operating unit and disposed on the switch body, and a movable contact switching in conjunction with the switch driver. Furthermore, at least one of the switch operating unit and the switch driver is composed of a transparent material, and illuminating means for illuminating the switch operating unit by guiding light emitted from a light-emitting element connected between the fixed contacts of at least one pole through at least one of the switch operating unit and the switch driver composed of the transparent material is provided. In this way, various types and forms of known switches can be changed to an illuminated type with a relatively low investment.

[B] An illuminated switch comprises a switch operating unit composed of a transparent material, a switch body, which includes a housing disposed on the switch operating unit so that the switch operating unit moves freely in the vertical direction and a base having a plurality of protruding terminals, a switching mechanism, which includes a converter composed of a transparent material and cooperates with the switch operating unit, a light-emitting element disposed on the base, and a movable contact piece that moves in accordance with the operation of the converter and functions as a change-over switch for a plurality of fixed contacts constituting at least one circuit on the bottom surface of the base. A lens is provided integrally with the converter on a surface opposing the light-emitting element. The lens diffuses light emitted from the light-emitting element through the inner space of the coil spring urging the switch operating unit vertically. Furthermore, a tilted surface is formed at an angle inclining towards the bottom surface of a hole formed below the upper surface of the switch operating unit in the axial direction. In this way, an illuminated switch having a high visibility can be easily provided.

Embodiments of the present invention will now be described in detail by referring to the drawings.

Figure 4:
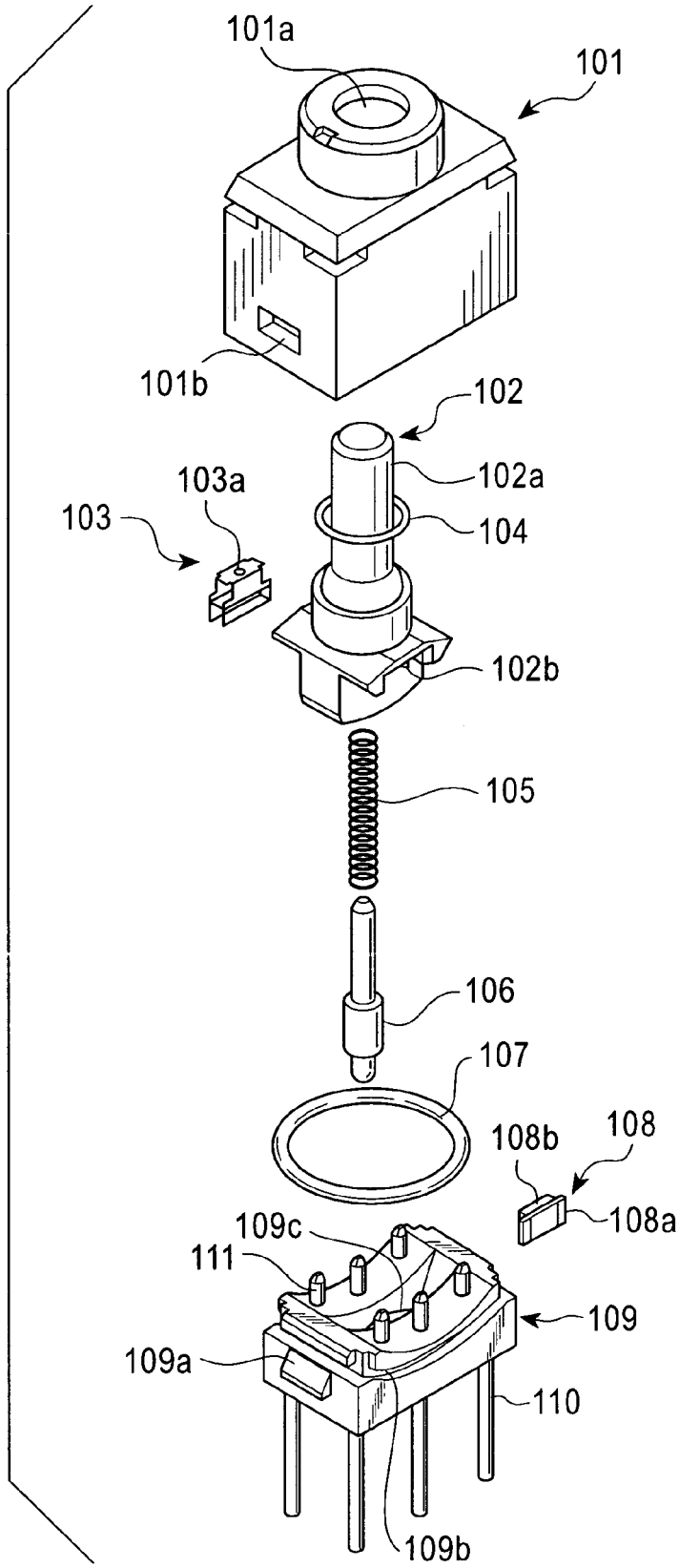
FIG. 4 is an exploded perspective view of an illuminated switch according to a first embodiment of the present invention.
Figure 5:
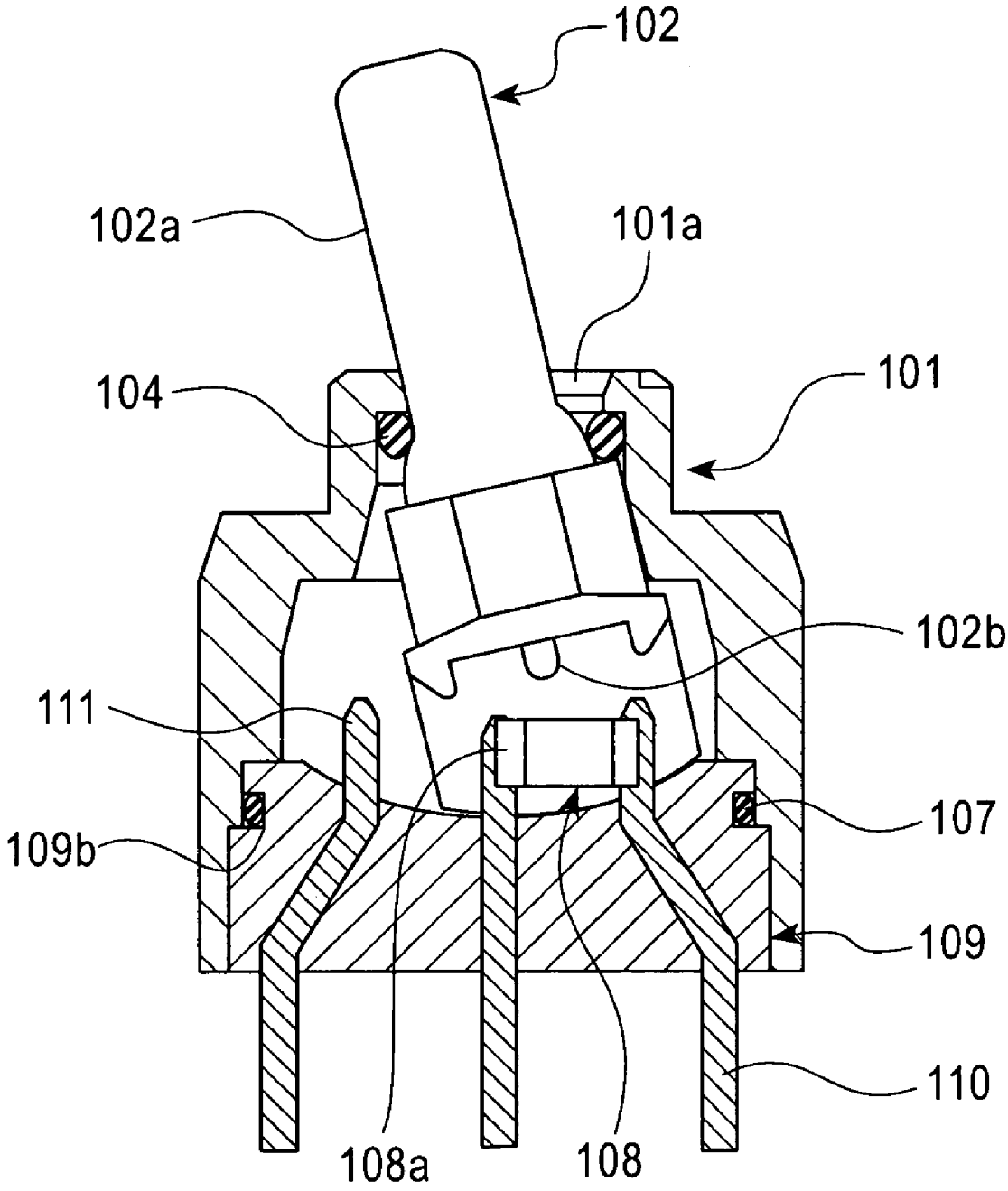
FIG. 5 is a cross-sectional front view of an illuminated switch according to a first embodiment of the present invention, viewed from the side of a light-emitting element.
Figure 6:
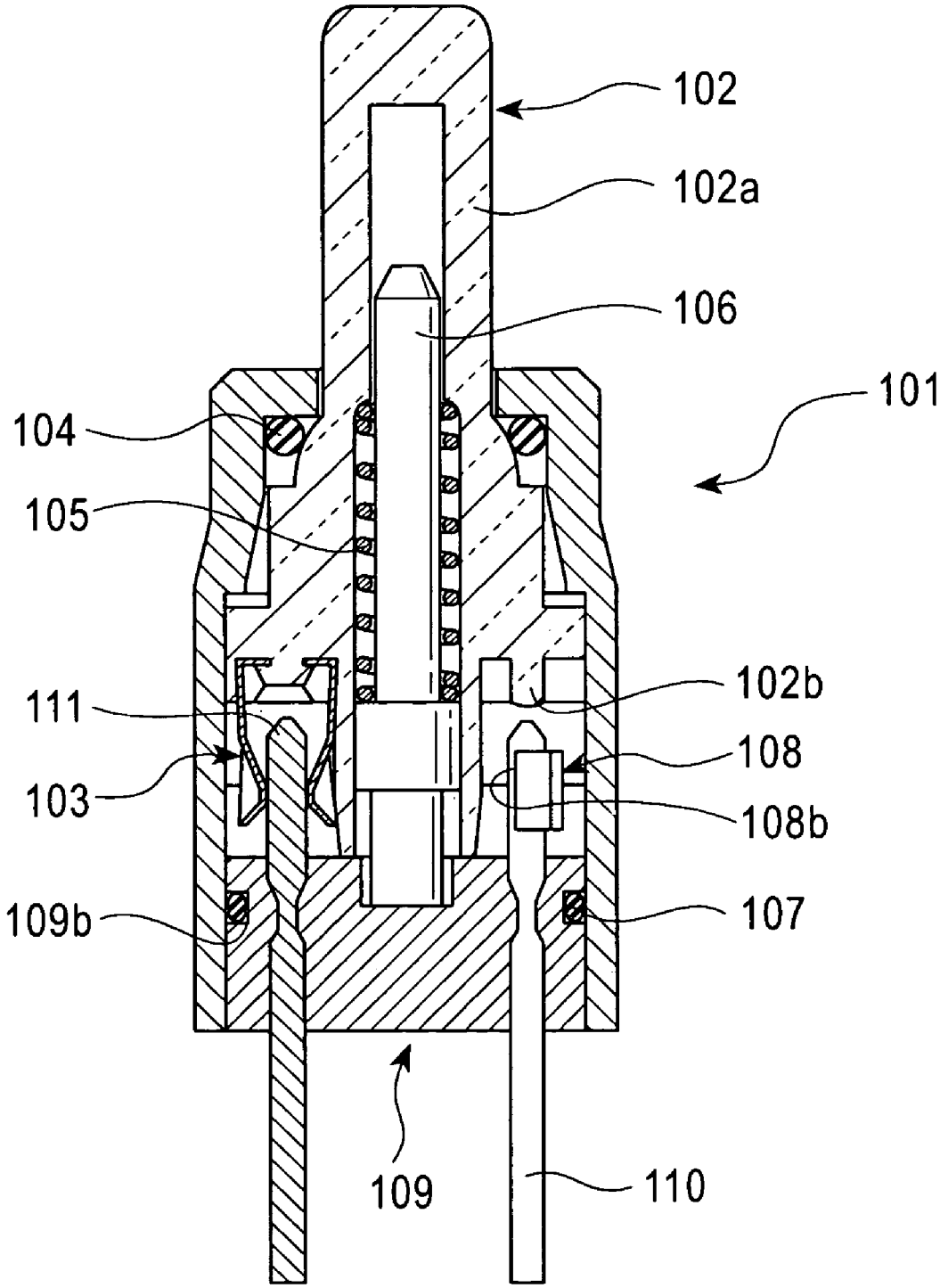
FIG. 6 is a cross-sectional side view of an illuminated switch according to a first embodiment of the present invention, viewed from the side of a light-emitting element.
Figure 7:
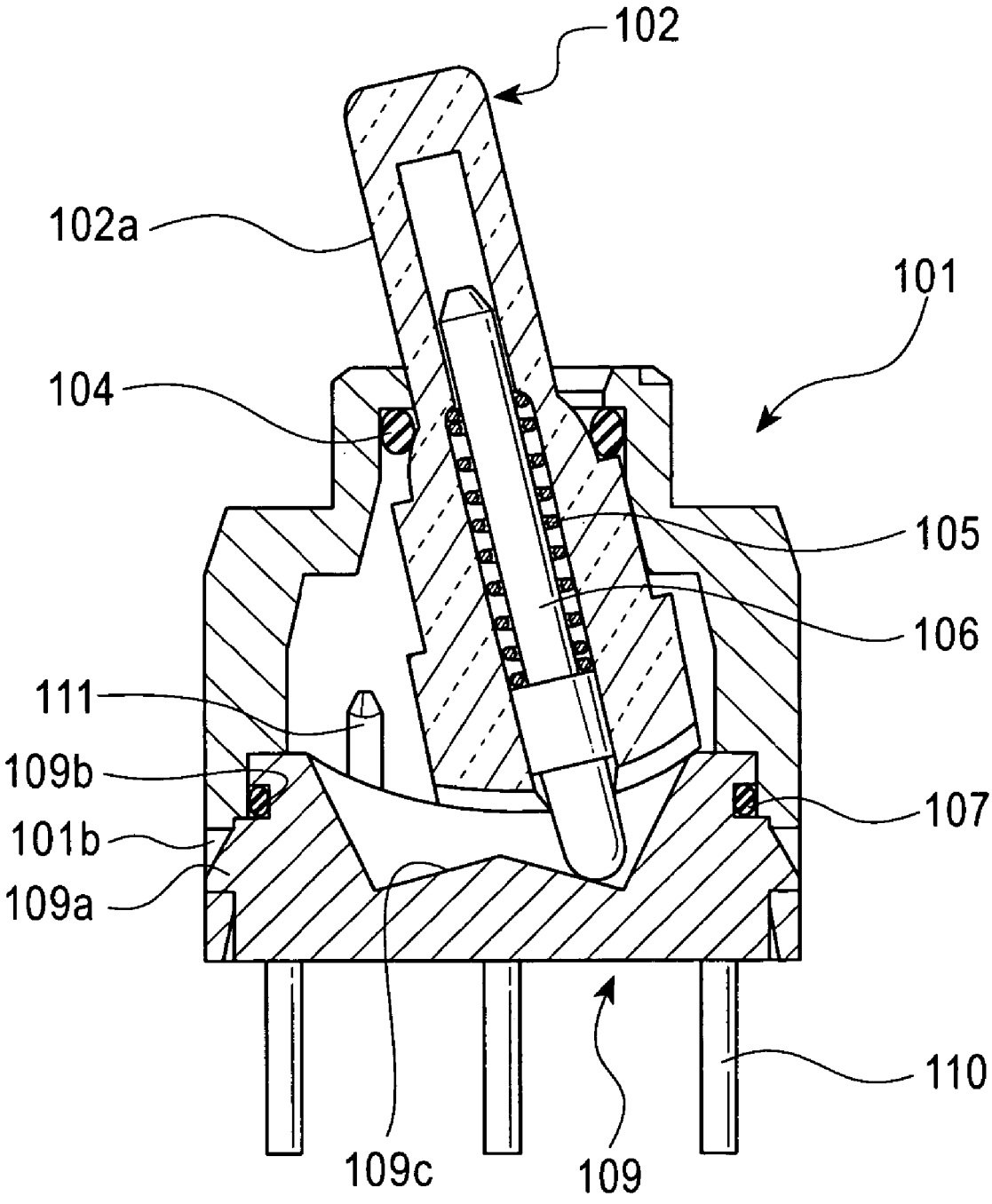
FIG. 7 is cross-sectional view of an illuminated switch according to a first embodiment of the present invention, viewed from the side of a light-emitting element.

FIG. 4 is an exploded perspective view of an illuminated switch according to a first embodiment of the present invention. FIG. 5 is a cross-sectional front view of the illuminated switch viewed from the side of a light-emitting element. FIG. 6 is a cross-sectional side view of the illuminated switch. FIG. 7 is a cross-sectional view of the illuminated switch.

As shown in the drawings, a toggle switch is composed by passing through a switch operating unit 102*a* of a lever 102, which is composed of a transparent material, from the inner side of a through-hole 101*a* formed on the upper surface of a box-shaped housing 101, which constitutes a switch body. A clip-type movable contact piece 103 is fixed onto the lever 102, which is a switch driver, by swaging the movable contact piece 103 onto a protrusion 102*b* of the lever 102 through a hole 103*a* formed on the upper portion of movable contact piece 103. The center portion of the lever 102 contains a coil spring 105 and a sliding rod 106. An engagement protrusion 109*a* of a base 109 is engaged with a rectangular window 101*b* of the housing 101 by inserting the base 109 into the housing 101 from below.

The base 109 has fixed contacts 111 that have a two-pole double throw arrangement in which the fixed contacts 111 are aligned in two rows of three fixed contacts 111. The movable contact piece 103 is disposed so that it pinches the fixed contacts 111 of one of the poles. An LED 108, which is a light-emitting element, is disposed vertically on the fixed contacts 111 of the other pole so that a light-emitting unit 108*b* of the LED 108 faces the lever 102.

An O-ring 104 seals the tilted portion between the housing 101 and the lever 102. An O-ring 107 is disposed in a groove 109*b* of the base 109 to prevent penetration of flux.

As described above, FIG. 1 is a cross-sectional side view of a known toggle switch for a printed circuit board. The illuminated switch according to the present invention has almost the same structure as this known toggle switch except that a light-emitting element is disposed on one side of the switch. Therefore, the switch may be selectively used as an illuminated switch or a non-illuminated switch depending on whether a light-emitting element is provided. Thus, the illuminated switch according to the present invention may be used for various types of switches.

Figure 8:
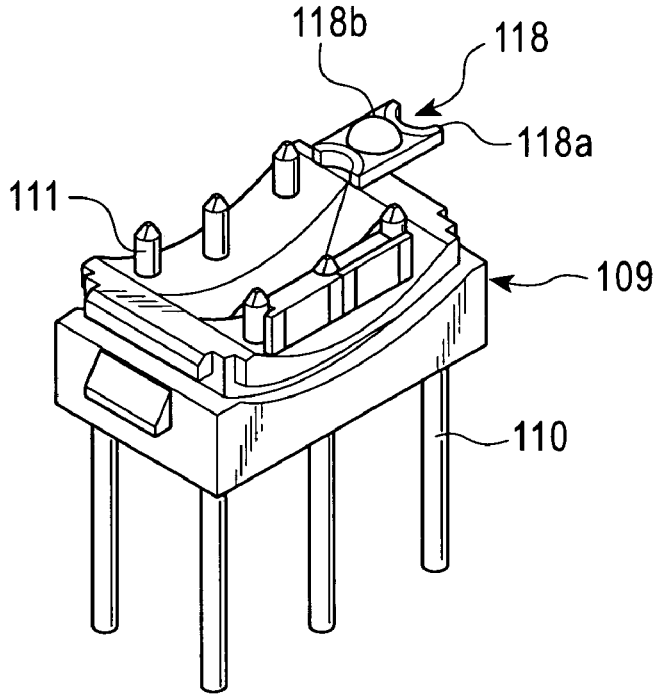
FIG. 8 illustrates a first arrangement of a light-emitting element of an illuminated switch according to the present invention.

FIG. 8 illustrates a first arrangement of a light-emitting element of an illuminated switch according to the present invention. A light-emitting element 118 includes an electrode 118*a* and a light-emitting unit 118*b* interposed between the fixed contacts 111.

Figure 9:
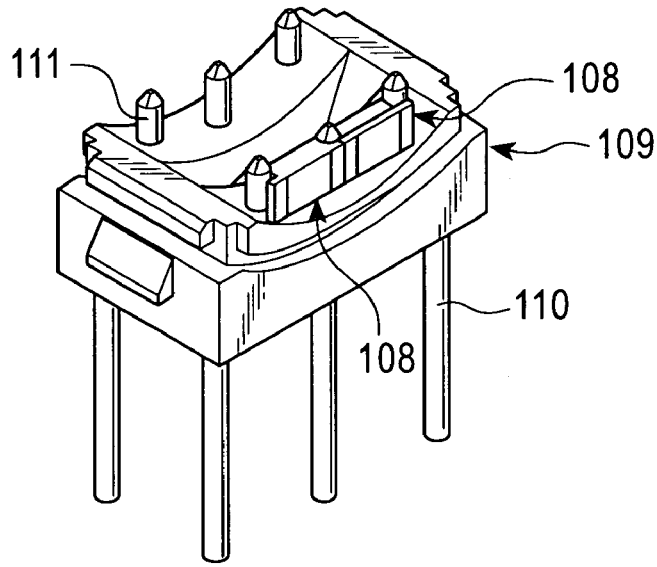
FIG. 9 illustrates a second arrangement of a light-emitting element of an illuminated switch according to the present invention.

FIG. 9 is a second arrangement of a light-emitting element of an illuminated switch according to the present invention. In this embodiment, as shown in the drawing, a base 109 has two poles, each pole including three fixed contacts 111. Two light-emitting elements 108, each emitting a different color, are disposed on the left and right of the fixed contact in the middle of the three fixed contacts of one of the poles so that the fixed contact in the middle functions as a common contact for both of the light-emitting elements. Depending on the direction in which the switch operating unit is tilted, two different colors are emitted. In this way, a three-terminal, two-color illuminated switch can be provided extremely easily.

Furthermore, by providing a chip resistor as one of the light-emitting elements, an illuminated switch having a built-in resistor for current limitation is provided. Moreover, the present invention may be applied to a slide switch or a rotary switch. The present invention does not exclude such switches.

Figure 10:
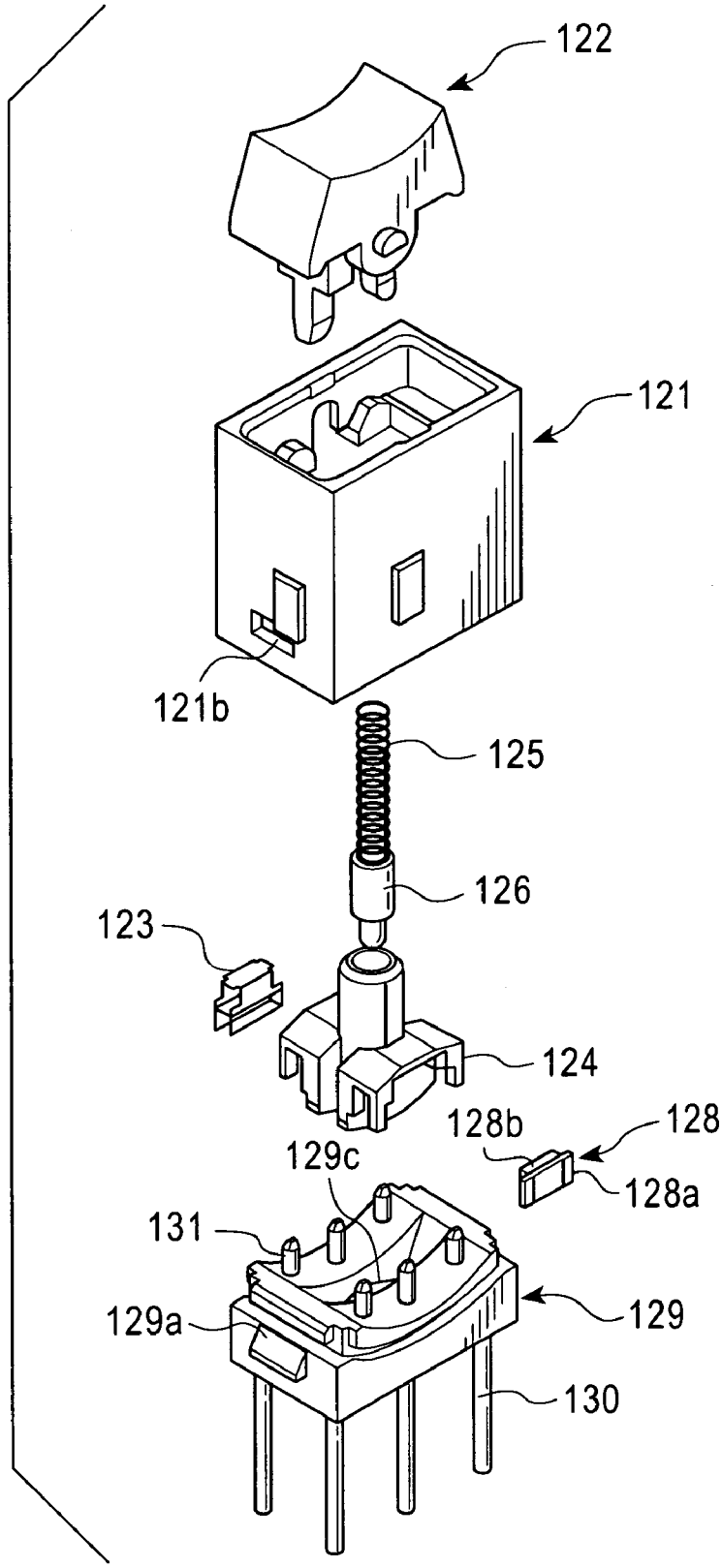
FIG. 10 is an exploded perspective view of an illuminated switch according to a second embodiment of the present invention.

FIG. 10 is an exploded perspective view of an illuminated rocker switch according to a second embodiment of the present invention. In this embodiment, a converter 124 and a button 122 are composed of a transparent material.

Figure 11:
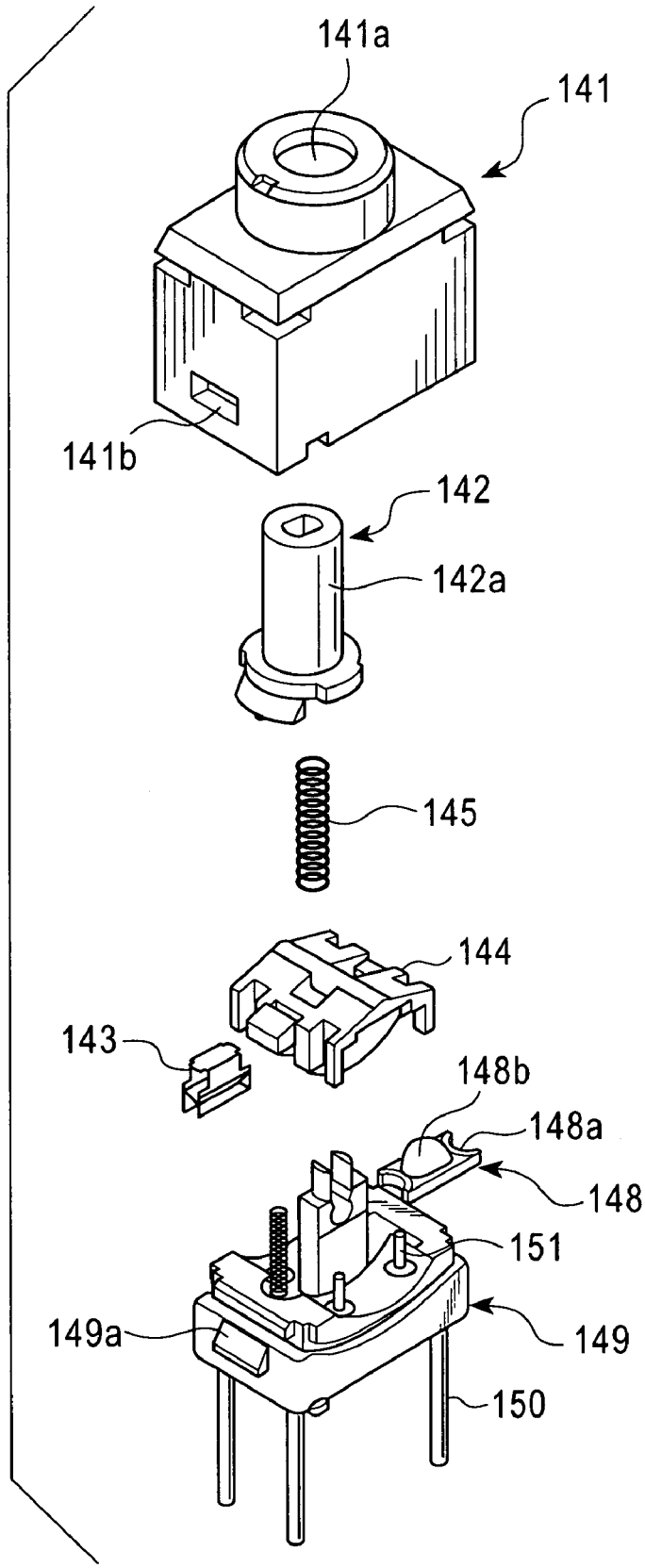
FIG. 11 is an exploded perspective view of an illuminated switch according to a third embodiment of the present invention.

FIG. 11 is an exploded perspective view of an illuminated push-button switch according to a third embodiment of the present invention. In this embodiment, a converter 144 and a plunger 142 are composed of a transparent material. A light emitting element is interposed between fixed contacts 151 while facing upwards (similar to FIG. 8). The light-emitting element may be fixed to the fixed contacts 151 at a predetermined position by welding, use of a heat-resistant conductive adhesive, spot welding, or mechanical attachment.

In the above-mentioned embodiments, the switch operating unit is illuminated. By composing other components constituting the switch body, such as the housing and base, entirely or partly of transparent material, an illuminated switch that illuminates in a different manner from a known illuminated switch may be provided.

Figure 12:
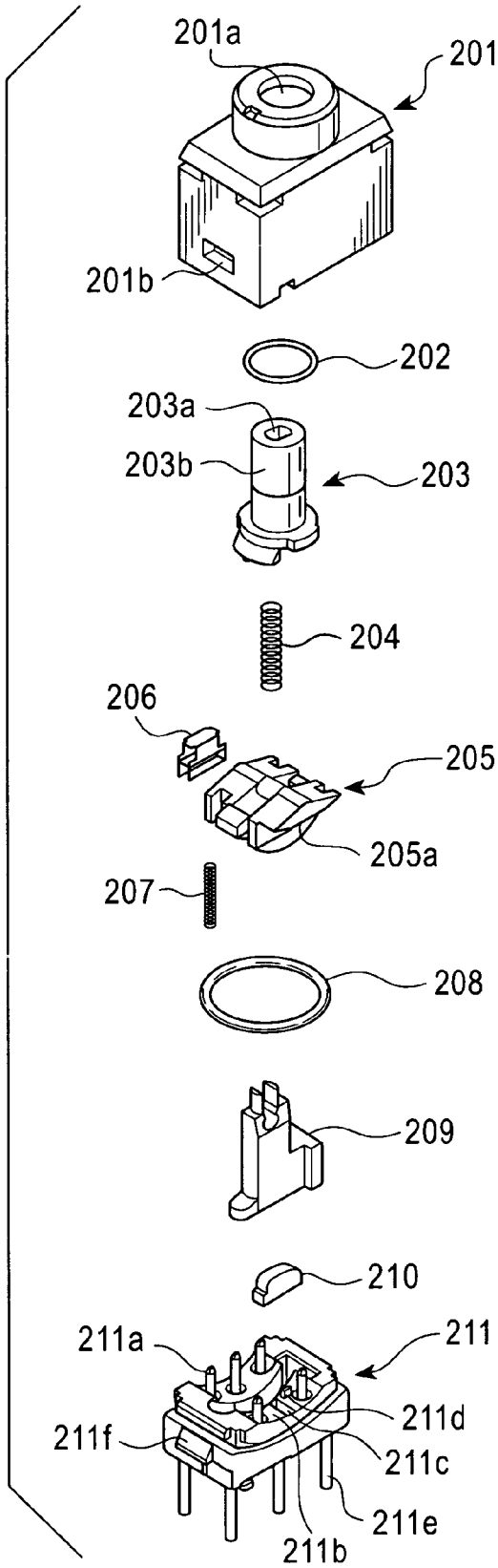
FIG. 12 is an exploded perspective view of an illuminated switch according to a fourth embodiment of the present invention.
Figure 13:
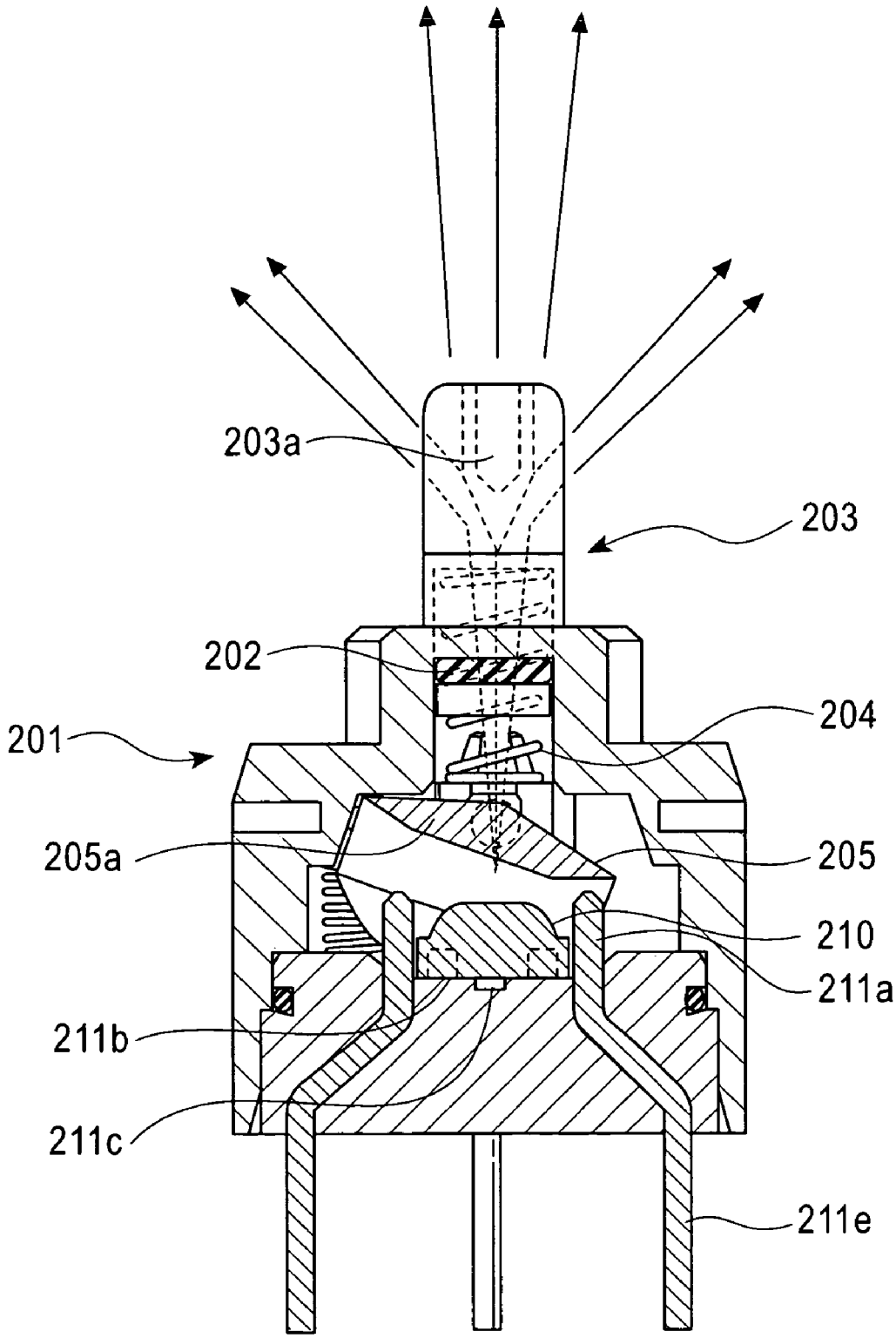
FIG. 13 is a cross-sectional front view of the illuminated switch according to the fourth embodiment of the present invention, viewed from the side of a light-emitting element.
Figure 14:
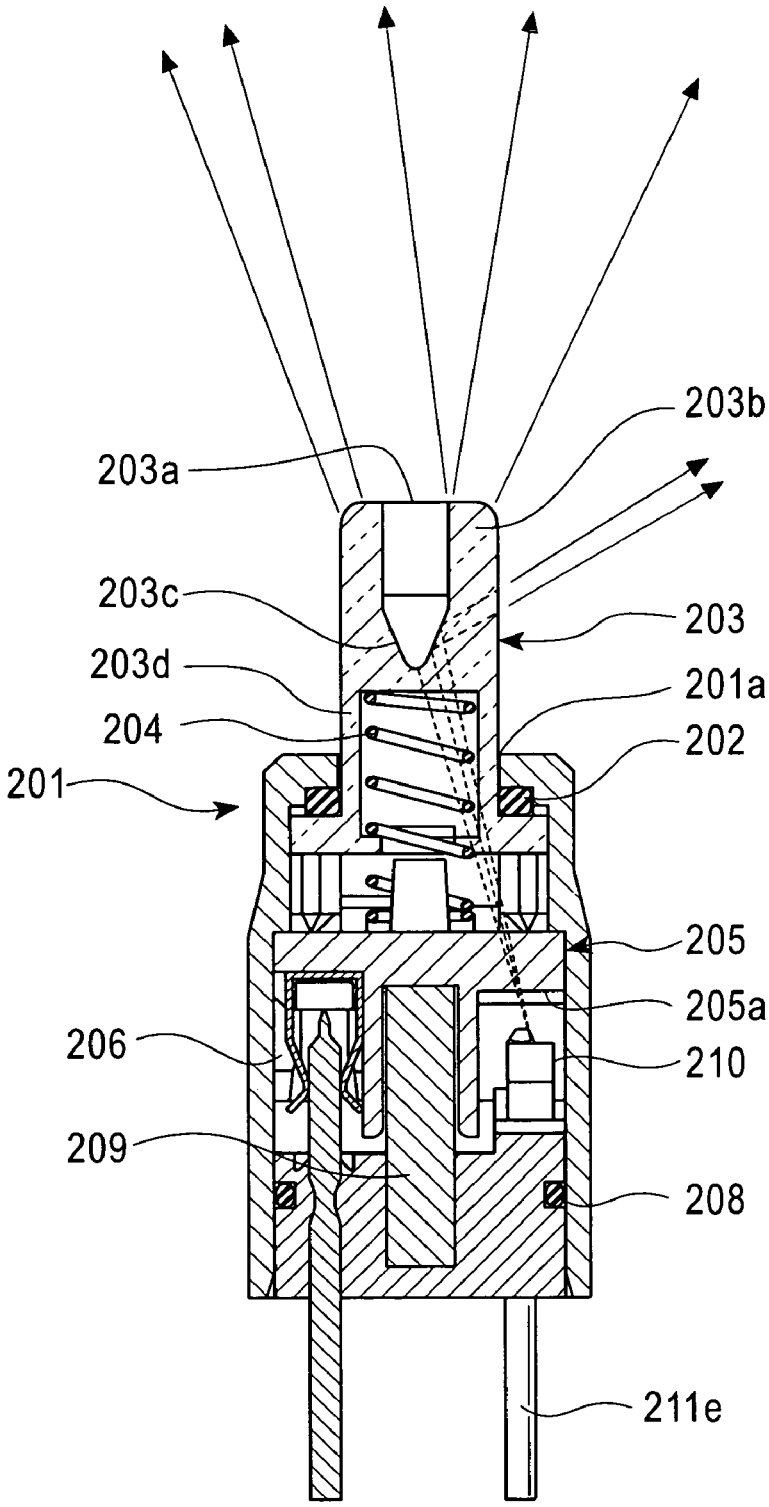
FIG. 14 is a cross-sectional side view of the illuminated switch according to the fourth embodiment of the present invention, viewed from the side of a light-emitting element.

FIG. 12 is an exploded perspective view of an illuminated switch according to a fourth embodiment of the present invention. FIG. 13 is a cross-sectional front view of the illuminated switch according to the fourth embodiment of the present invention, viewed from the side of a light-emitting element. FIG. 14 is a cross-sectional side view of the illuminated switch according to the fourth embodiment of the present invention.

Figure 15:
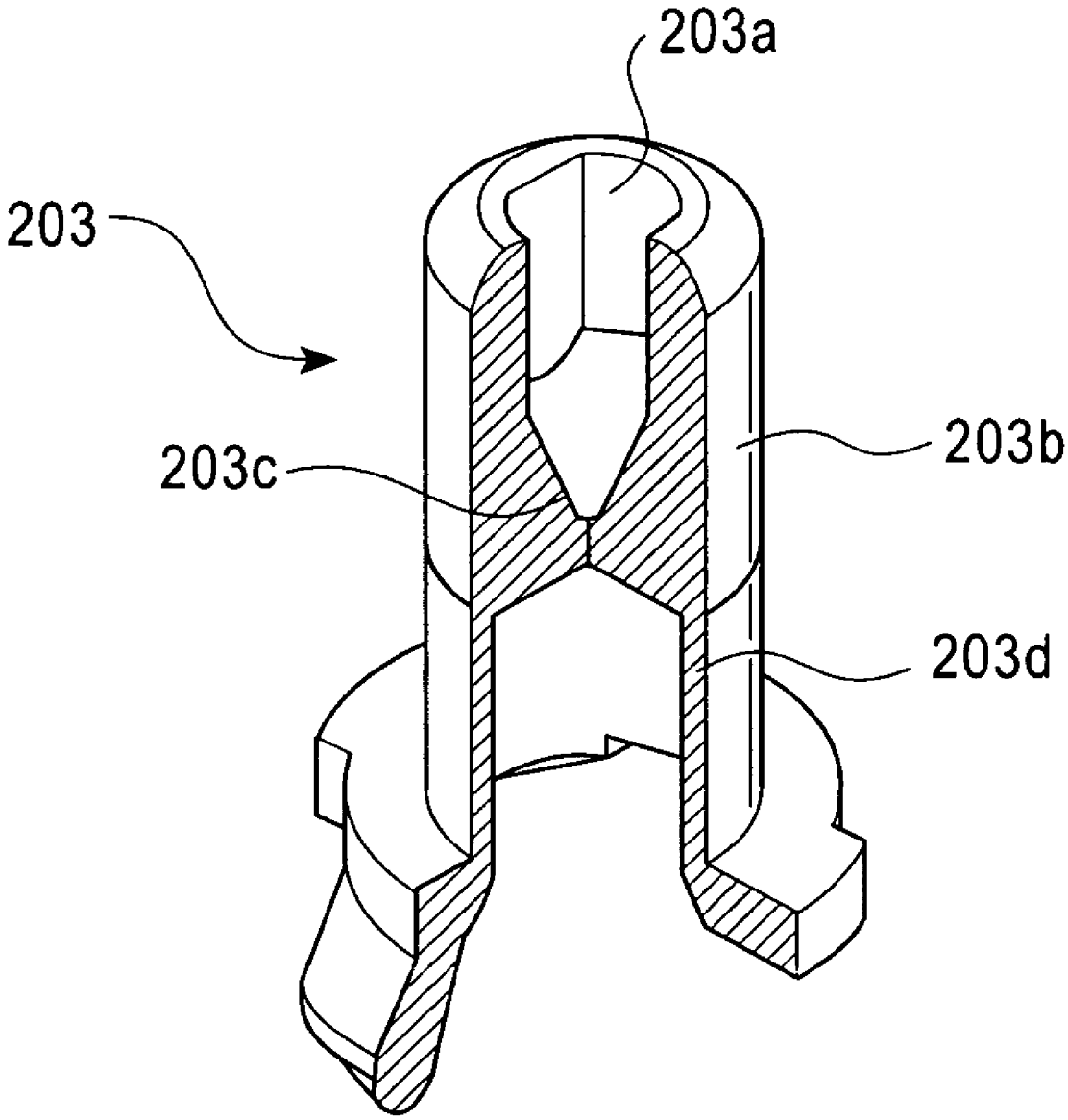
FIG. 15 is a perspective view including a cross-section of the inner structure of a plunger of the illuminated switch according to the fourth embodiment of the present invention.
Figure 16:
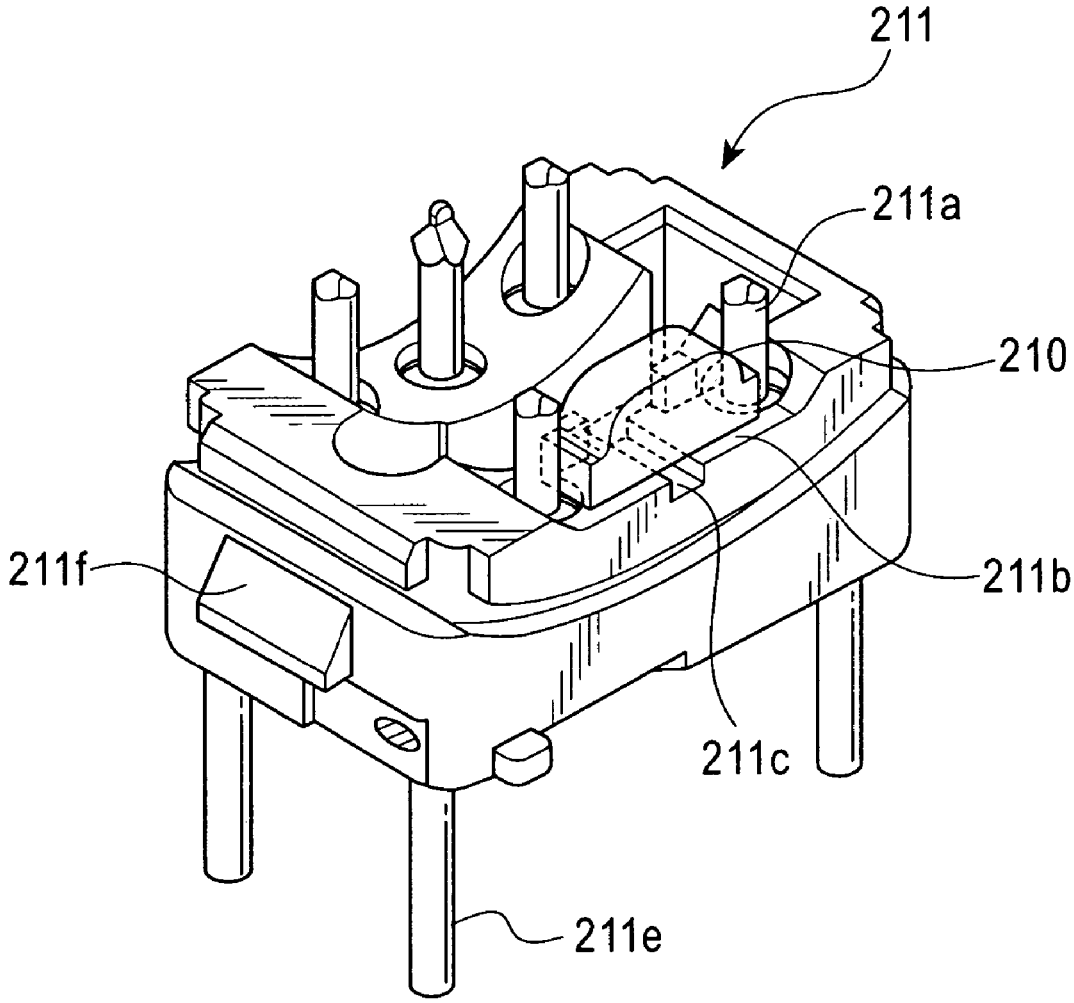
FIG. 16 is a perspective view of the position of a base and a light-emitting element of the illuminated switch according to the fourth embodiment of the present invention.

Furthermore, FIG. 15 is a perspective view including a cross-section of the inner structure of a plunger, which functions as a switch operating unit, of the illuminated switch according to the fourth embodiment of the present invention. FIG. 16 is a perspective view illustrating the arrangement of a base and a light-emitting element.

In these drawings, a housing 201 and a base 211 constitute a switch body. A plunger 203, which has a tilted surface 203*c* at the bottom of a hole 203*a* formed on the upper surface of the plunger 203, functions as a switch operating unit 203*b*. A push-button switch is constituted by passing the plunger 203 from the inside of the housing 201 through a through-hole 201*a* formed on the upper surface of the housing 201.

Inside the switch body, a switching mechanism that works together with the vertical movement of the plunger 203 is provided. The switching mechanism includes a clip-type movable contact piece 206 attached to a converter 205 so that the movable contact piece 206 moves in conjunction with the switching movement of the converter 205. Moreover, a lens 205*a* is disposed on the surface of the converter 205 opposing a light-emitting element 210 mentioned below. In this way, the emitted light is easily guided through the illuminated switch.

The base 211 includes vertically-disposed fixed contacts 211*a* arranged in a plurality of rows. The movable contact piece 206 is attached to one of the rows of fixed contacts 211*a* and the light-emitting element 210 is disposed in alignment with the other row of fixed contacts 211*a*. The light-emitting element 210 is connected to the fixed contacts 211*a* by being positioning on a flat surface 211*b* formed on the base 211 and then being held in position by the fixed contacts 211*a* on the left and right of the light-emitting element 210 in the same row and by a protrusion 211*d* on the side surface. Furthermore, a groove 211*c* is formed on the flat surface 211*b* to facilitate the application of a conductive adhesive.

A guide 209 is disposed on substantially the center of the base 211. A coil spring 207 for urging the converter 205 during a switching operation and a coil spring 204 for urging the plunger 203 during a vertical movement are provided. The base 211 is passed through the housing 201 from below to engage an engagement protrusion 211*f* of the base 211 with a rectangular window 201*b* of the housing 201. Light emitted from the lens 205*a* is guided through the inner space of the coil spring 204 urging the plunger 203 during the vertical movement. The light is then reflected at the tilted surface 203*c* formed on the switch operating unit 203*b* of the plunger 203. In this way, a light path towards the side surface of the switch operating unit 203*b* is secured.

An upper O-ring 202 seals a slidable portion between the housing 201 and the plunger 203. A lower O-ring 208 is disposed in a groove formed on the base 211 to prevent the penetration of flux.

What is claimed is:

1. An illuminated switch comprising:

a switch operating unit composed of a transparent material;

a switch body comprising:

a housing disposed on the switch operating unit so that the switch operating unit moves freely in the vertical direction and a base having a plurality of protruding terminals;

a switching mechanism comprising:

a converter composed of a transparent material and cooperates with the switch operating unit;

a light-emitting element disposed on the base; and a movable contact piece that moves in accordance with the operation of the converter and functions as a change-over switch for a plurality of fixed contacts constituting at least one circuit on the bottom surface of the base; wherein, a lens is provided integrally with the converter on a surface opposing the light-emitting element, the lens diffuses light emitted from the light-emitting element through the inner space of the coil spring urging the switch operating unit in the vertical direction, and a tilted surface is formed at an angle inclining towards the bottom surface of a hole formed below the upper surface of the switch operating unit.

2. An illuminated switch according to claim 1, wherein a flat surface and a protrusion are formed on the surface of the base where at least a pair of the fixed contacts is vertically disposed and where at least one groove is formed.

* * * * *